United States Patent [19]

Buschow

[11] Patent Number: 4,582,535

[45] Date of Patent: Apr. 15, 1986

[54] INVAR ALLOY ON THE BASIS OF IRON HAVING A CRYSTAL STRUCTURE OF THE CUBIC $NAZN_{13}$ TYPE, AN ARTICLE HEREFROM

[75] Inventor: Kurt H. J. Buschow, Eindhoven, Netherlands

[73] Assignee: U.S. Philips Corporation, New York, N.Y.

[21] Appl. No.: 702,097

[22] Filed: Feb. 14, 1985

Related U.S. Application Data

[62] Division of Ser. No. 574,776, Jan. 27, 1984, Pat. No. 4,529,445.

[30] Foreign Application Priority Data

Feb. 8, 1983 [NL] Netherlands ..... 8300465

[51] Int. Cl.[4] ..... B22F 1/00

[52] U.S. Cl. ..... 75/246; 75/228; 75/249

[58] Field of Search ..... 75/228, 245, 246, 249, 75/123 K, 123 E, 124 F, 123 L

[56] References Cited

FOREIGN PATENT DOCUMENTS 55-6495 1/1980 Japan ..... 75/123 K 58-174501 10/1983 Japan ..... 75/246

*Primary Examiner*—L. Dewayne Rutledge

*Assistant Examiner*—Deborah Yee

*Attorney, Agent, or Firm*—Norman H. Spain

[57] ABSTRACT

An Invar type alloy on the basis of iron is formed by an intermetallic compound having a cubic crystal structure of the $NaZn_{13}$ type having a nominal composition $La(FeCoX)_{13}$, wherein X is Si or Al. By subjecting the present intermetallic compound after melting to a tempering treatment at 800°-1,000° C. and cooling it in an accelerated manner, a brittle material is obtained which can be ground to form a powder. From this powder, articles having any desired (optionally complicated) shape can be produced by means of powder metallurgy. By mixing powders of two different intermetallic compounds, a material can be obtained having a substantially negligible coefficient of linear thermal expansion in the temperature range from 0° C. to 200° C.

4 Claims, 5 Drawing Figures

INVAR ALLOY ON THE BASIS OF IRON HAVING A CRYSTAL STRUCTURE OF THE CUBIC $NAZN_{13}$ TYPE, AN ARTICLE HEREFROM

This is a division of application Ser. No. 574,776 filed Jan. 27, 1984, now U.S. Pat. No. 4,529,445.

The invention relates to an Invar alloy on the basis of iron.

The anomalous expansion characteristics of (binary) irion-nickel alloys having from 30% to 50% nickel are well known. Invar type, for example, an iron-nickel alloy having approximately 35 at.% nickel, has an extremely low coefficient of thermal expansion at room temperature. For this reason the alloy has since its discovery in 1897, been used for various practical applications. Subsequently, comparable (ternary) alloy systems based on iron, for example, super-Invar (4Co32Ni—Fe) and stainless steel Invar (11Cr52Co—Fe) were found which both show substantially no thermal expansion at room temperature.

Materials having the above-mentioned properties are known as Invar type alloys. For a more detailed description of the properties of Invar type alloys, reference may be made, for example, to the article by Scott in Transactions of the American Society for Steel Treating, vol. 13, 1928, p. 829.

A disadvantage for industrial application of the known Invar alloys, however, is that they are ductile, as a result of which time-consuming and expensive mechanical treatments are necessary to manufacture therefrom workpieces of a given shape, in particular when this is a complicated shape.

Primarily it is the object of the invention to provide an Invar type alloy which can be obtained in a readily machinable form.

According to the invention such an alloy is characterized in that it comprises an intermetallic compound having a crystal structure of the cubic $NaZn_{13}$ type and having a nominal composition $La(FeCoX)_{13}$, wherein X is Si or Al.

It has been found that intermetallic compounds of the above type can be obtained as a brittle material in a simple manner and have an extremely small coefficient of thermal expansion in an extensive temperature range. In this brittle form they can be pulverized and the resulting powder particles can then be compressed or sintered to compact articles having any desired shape, with or without the addition of a binder.

The invention therefore also relates to articles from intermetallic compounds having the composition $La(FeCoX)_{13}$ and made by means of powder metallurgy.

The invention also relates to a method of obtaining the material in a brittle form. A method according to the invention of producing an alloy having a composition $La(Fe,Co,X)_{13}$, where X is Si or Al is for that purpose characterized by the following steps: forming a melt from the required starting components, cooling the melt, subjecting the resulting moulding to a tempering treatment at a temperature in the range from 800°–1000° C., succeeded by accelerated cooling to room temperature.

The possibility of obtaining the intermetallic compounds according to the invention in powder form still provides an extra advantage. By mixing powders of two intermetallic compounds having coefficients of linear thermal expansion of opposite signs, materials can be obtained having a substantially negligibly small coefficient of linear thermal expansion in the temperature range from 0° to 200° C. or even the temperature range from 0° to 300° C., respectively.

For that purpose, a further aspect of the invention relates to an article obtained by powder metallurgy from a mixture of two alloys of the composition described hereinbefore, in which one alloy in a given temperature range has a negative coefficient of thermal expansion and the other alloy in the same temperature range has a positive coefficient of thermal expansion.

For that purpose, still a further aspect of the invention relates to an article obtained by means of powder metallurgy from a mixture of two alloys of the composition described hereinbefore, in which the coefficient of thermal expansion as a function of the temperature of one alloy in a given temperature range shows a maximum and in which the coefficient of thermal expansion as a function of the temperature of the other alloy in the same temperature range shows a minimum.

A few embodiments of the invention will be described in greater detail with reference to the drawings, in which FIG. 1 is a graph showing the coefficient of thermal expansion plotted as a function of the temperature of three intermetallic compounds from the $La(FeCo)_{11}Si_2$ system;

Figure 4:
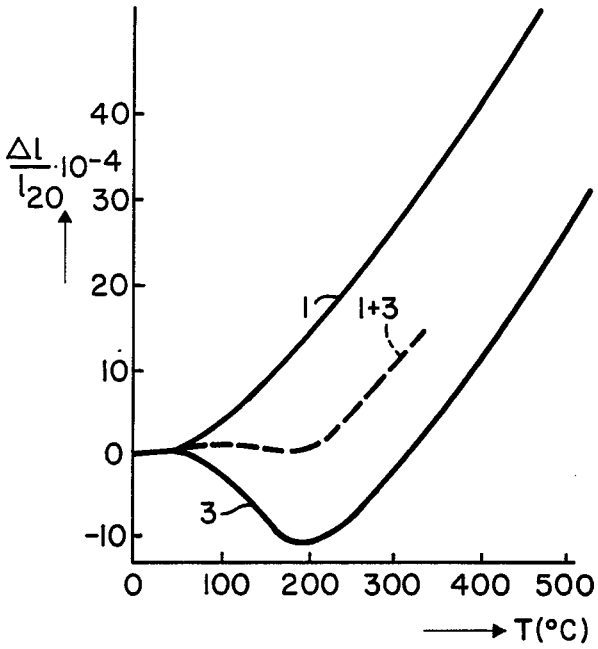
Figure 5:
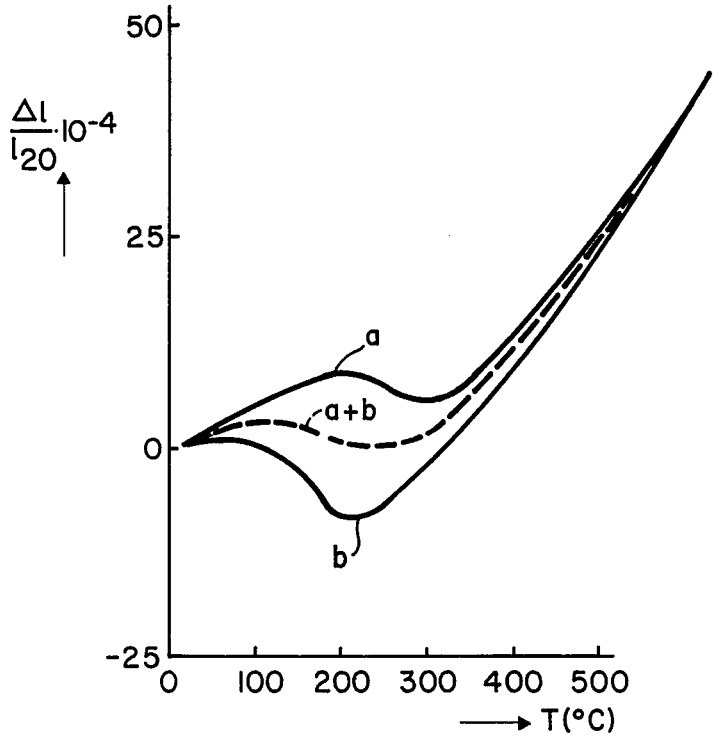

FIG. 4 is a graph showing the coefficient of thermal expansion plotted as a function of the temperature of two intermetallic compounds from the $La(FeCo)_{11.5}Al_{1.5}$ system and of a mixture of these two intermetallic compounds, and FIG. 5 is a graph showing the coefficient of thermal expansion plotted as a function of the temperature of two intermetallic compounds from the $La(FeCo)_{11.5}Al_{1.5}$ system and of a mixture of these two intermetallic compounds.

According to the invention, three intermetallic compounds were prepared by melting the starting components in an argon gas atmosphere (flow rate 300 ml of Ar/min.) of the respective compositions $$LaFe_{10}Co_1Si_2 \quad \text{(I)}$$

$$LaFe_9Co_2Si_2 \quad \text{(II)}$$

$$LaFe_8Co_3Si_2 \quad \text{(III)}$$

Figure 1:
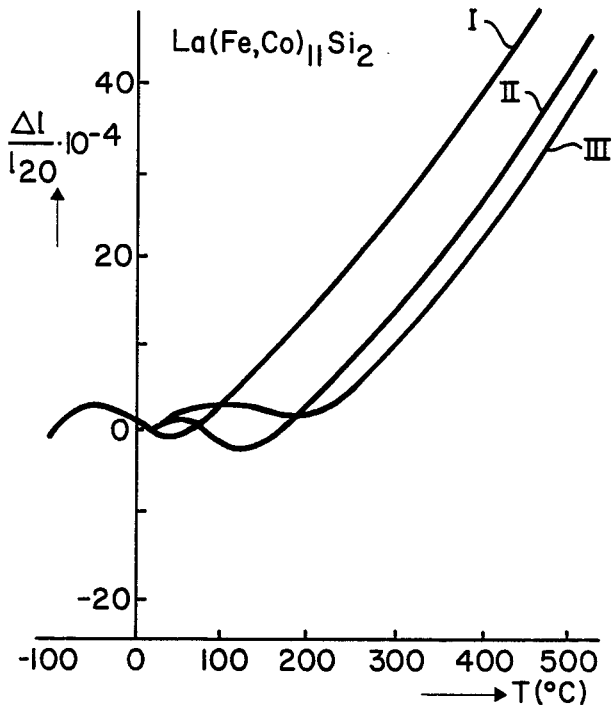

The coefficient of linear expansion $\Delta l/l_{20}$ of mouldings of these intermetallic compounds was measured as a function of the temperature. The measured results are recorded in FIG. 1. It will be obvious that the coefficients of expansion show an anomaly. The temperature range in which said anomaly occurs depends on the Co-content of the compounds: The temperature range from approximately 0° C. to approximately 200° C. for compounds II and III, the temperature range from approximately −100° C. to +100° C. for compound I. The coefficients of linear thermal expansion is very small in these temperature ranges. The intermetallic compounds I, II and III which all three of them show the cubic $NaZn_{13}$ crystal structure, are hence of the Invar type.

With increasing Co-content, the temperature range in which the anomalous behaviour of the coefficient of linear thermal expansion occurs, and notably the temperature where a minimum value of the coefficient of linear thermal expansion occurs, moves to higher temperatures. However, at the same time the anomalous behaviour in itself becomes less pregnant with increasing Co-content.

The same picture is demonstrated by measurements of the coefficient of linear thermal expansion as a function of the temperature in mouldings of five intermetallic compounds from the $La(FeCo)_{11.5}Al_{1.5}$ system. These five intermetallic compounds had the respective compositions:

$LaFe_{11}Co_{0.5}Al_{1.5}$ (1)

$LaFe_{10.5}Co_1Al_{1.5}$ (2)

$LaFe_{9.5}Co_2Al_{1.5}$ (3)

$LaFe_{8.9}Co_{2.6}Al_{1.5}$ (4)

$LaFe_{8.5}Co_3Al_{1.5}$ (5)

Figure 2:
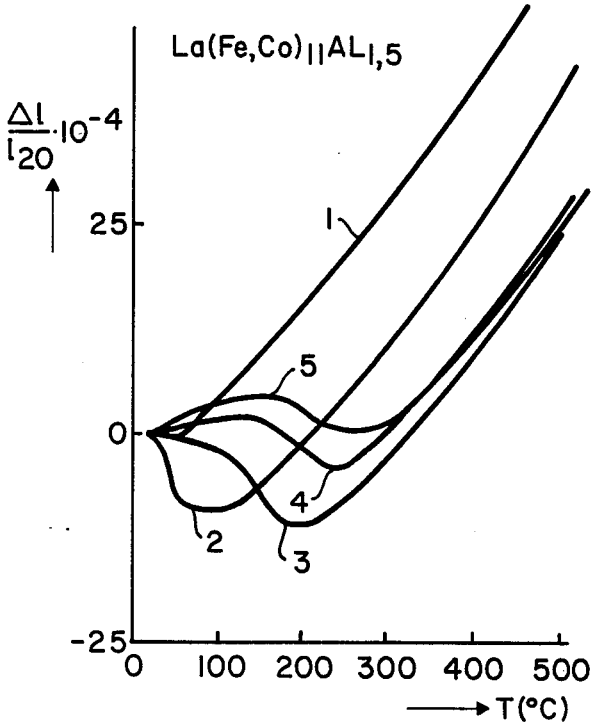
FIG. 2 is a graph showing the coefficient of thermal expansion plotted as a function of the temperature of five intermetallic compounds from the $La(FeCo)_{11.5}Al_{1.5}$ system.

The measured results are shown in FIG. 2. The temperature range where the coefficient of linear thermal expansion shows an anomaly extends from approximately 0° C. to approximately 300° C. in the case of the intermetallic compounds 2, 3, 4 and 5. In the case of compound 1 said temperature range has moved to lower temperatures.

The intermetallic compounds 1–5, all of which show the cubic $NaZn_{13}$ crystal structure, hence are also of the Invar type.

A third group of intermetallic compounds that have been examined belong to the $La(Fe,Co)_{11}Al_2$ system. The compounds in question had the following compositions:

$LaFe_{10.5}Co_{0.5}Al_2$ (A)

$LaFe_{10}Co_1Al_2$ (B)

$LaFe_9Co_2Al_2$ (C)

Figure 3:
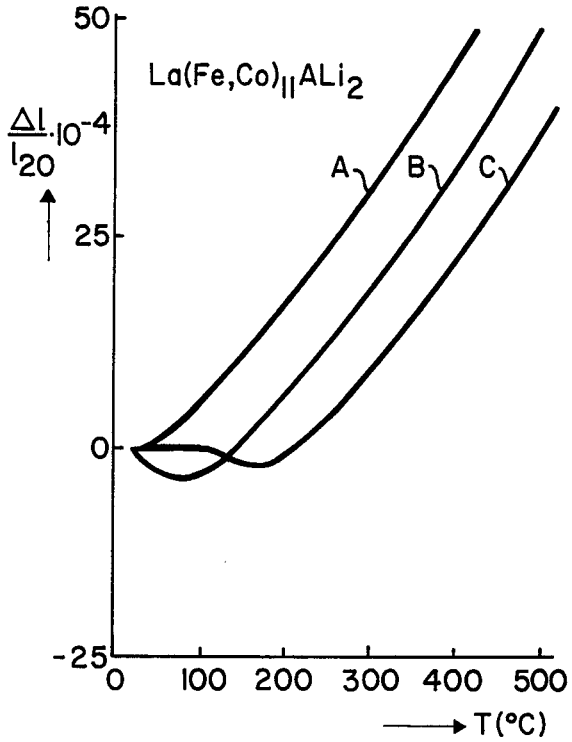
FIG. 3 is a graph showing the coefficient of thermal expansion plotted as a function of the temperature of three intermetallic compounds from the $La(FeCo)_{11}Al_2$ system.

The measured results are shown in FIG. 3. The temperature range where the coefficient of linear thermal expansion shows an anomaly extends from approximately 0° C. to approximately 200° C. in the case of the intermetallic compounds B and C. In the case of compound A, said temperature range has moved to lower temperatures. The intermetallic compounds A–C, all of which show the cubic $NaZn_{13}$ crystal structure are hence also of the invar type.

The eleven intermetallic compounds mentioned hereinbefore $LaFe_{13-x-y}Co_xX_y$ wherein X is Si or Al, are intermetallic compounds of the invar type having the cubic $NaZn_{13}$ crystal structure, and having a predominantly ferromagnetic coupling between the magnetic 3*d* moments. If y becomes too large (larger than 2.5 when X=Si and larger than 3 when X=Al, then the magnetic ordering temperature becomes too far below room temperature for practical applications. If y becomes too small (smaller than 1.5 when X=Si and smaller than 1 when X=Al, then the cubic $NaZn_{13}$ crystal structure which is necessary is not formed.

As regards the quantity of Co represented by the parameter *x*, it holds that for practical applications, *x* must preferably not be smaller than 1.5 (with smaller values the temperature range where the anomaly in the coefficient of linear thermal expansion occurs becomes too far below room temperature), and must not be larger than 3 (with larger values the anomalous behaviour becomes smaller and smaller until ultimately the invar effect has disappeared. However, when powders of two different intermetallic compounds according to the invention are mixed, then compounds with *x* from 0.5 to 4.5 may be well useful. The effect of mixing two powders will be described in detail with reference to FIGS. 4 and 5.

FIG. 4 shows the coefficient of linear thermal expansion as a function of the temperature of the intermetallic compounds 1 and 3 (cf. FIG. 2). These have the composition $LaFe_{11}Co_{0.5}Al_{1.5}$ (1) and $LaFe_{9.5}Co_2Al_{1.5}$ (3). In the temperature range from 0° to 200° C., compound (1) has a positive coefficient of thermal expansion and compound (3) an essentially negative coefficient of thermal expansion. When powders of compound (1) and compound (3) are mixed in the ratio 45:55, this leads to a material having a coefficient of linear thermal expansion which is substantially negligible in the temperature range from 0° C. to 200° C. See the broken line.

FIG. 5 shows how, starting from powders of two different intermetallic compounds, a material having an extremely low coefficient of linear thermal expansion in the temperature range from 0° C. to 300° C. can be realised. Compound a as the composition $LaFe_{9.2}Co_{2.3}Al_{1.5}$ Compound b has the composition $LaFe_8Co_{3.5}Al_{1.5}$ The coefficient of linear thermal expansion of compound a shows a maximum in the temperature range from 0° C. to 300° C., while the coefficient of linear thermal expansion of compound b just shows a minimum in said temperature range. When powders of compound (a) and compound (b) are mixed in the ratio 50:50, this leads to a material having a coefficient of linear thermal expansion which is extremely low in the temperature range from 0° C. to 300° C. See the broken line. When moulds of intermetallic compounds according to the invention are subjected, after moulding, to a tempering treatment under a protective gas or in a vacuum at a temperature in the range from 800° to 1,000° C., the duration of the tempering treatment may be between 10 and 200 h, they show a brittle behaviour after accelerated cooling to room temperature. (As is known, the so far known Invar alloys show a ductile behaviour.) The thus thermally treated brittle mouldings may be pulverised. Articles having a desired shape are then obtained in a simple manner by compacting the alloy powders, mixed at will with at most 10% by weight of a binder (for example, a phenolic or an epoxy resin), by compression and/or sintering. Possible applications of articles of the present alloys obtained by means of powder metallurgy may be the applications, for example, which are mentioned in U.S. Pat. No. 2,266,481.

What is claimed is:

1. An article obtained, by means of powder metallurgy from a mixture of two iron containing Invar type alloys, one of said alloys having a negative coefficient of thermal expansion in a given temperature range, and the other of said alloys having a positive coefficient of thermal expansion in said temperature range and each of said alloys being an intermetallic compound having a crystal structure of the cubic $NaZn_{13}$ type and a composition of the formula $La(FeCoX)_{13}$ wherein X is Si or Al.

2. The article of claim 1 wherein each of said alloys has a composition of the formula $$LaFe_{13-x-y}Co_xSi_y$$

wherein $0.5 \leqq x \leqq 4.5$ $1.5 \leqq y \leqq 2.5$.

3. The article of claim 1 wherein each of said alloys has a composition of the formula $$LaFe_{13-x-y}Co_xAl_y$$

wherein $0.5 \leqq x \leqq 4.5$ $1 \leqq y \leqq 3$.

4. An article of claim 1, produced by means of powder metallurgy, wherein the coefficient of thermal coefficient as a function of temperature of one of said alloys exhibits a maximum in a given temperature range while the coefficient of thermal coefficient as a function of temperature of the other of said alloys exhibits a minimum in said temperature range.

* * * * *